US006705486B1

(12) United States Patent
Noell

(10) Patent No.: US 6,705,486 B1
(45) Date of Patent: Mar. 16, 2004

(54) MERCHANDISE GAME WITH PIVOTAL PRODUCT TRAYS

(76) Inventor: Robert E. Noell, P.O. Box 727, Ozona, FL (US) 34660

( * ) Notice: Subject to any disclaimer, the term of this patent is extended or adjusted under 35 U.S.C. 154(b) by 0 days.

(21) Appl. No.: 10/462,923

(22) Filed: Jun. 17, 2003

(51) Int. Cl.[7] ..... G07F 11/00
(52) U.S. Cl. ..... 221/82; 221/289
(58) Field of Search ..... 221/1, 82, 83, 221/92, 123, 133, 129, 105, 191, 268, 289

(56) References Cited

U.S. PATENT DOCUMENTS 5,848,935 A * 12/1998 Noell et al. ..... 463/16
6,315,157 B1 * 11/2001 Halliburton ..... 221/87

* cited by examiner

*Primary Examiner*—Kenneth W. Noland
(74) *Attorney, Agent, or Firm*—David Kiewit

(57) ABSTRACT

An arcade merchandise dispensing game delivers one or more visibly displayed articles from one of a plurality of pivotally mounted trays if a player causes a moving tripper to strike a portion of the tray so as to lift it far enough that one or more of the articles falls off the tray into a delivery chute. The strikable portion of the tray may be a tab that protrudes forward from the tray towards the player, where the width of the tab influences the probability of the tray's being struck. The tripper may be moved horizontally to and fro at a constant rate beneath the lowest of a number of rows of trays, and moved upwards in response to the player closing a momentary contact switch at an instant that the player believes is most likely to result in delivery of a desired one of the articles.

12 Claims, 4 Drawing Sheets

MERCHANDISE GAME WITH PIVOTAL PRODUCT TRAYS

BACKGROUND INFORMATION

The invention pertains to games of skill and chance in which a successful play results in delivery of at least one of a plurality of displayed prizes. More particularly, it relates to an arcade game in which an article is dispensed from a pivotally mounted supply container responsive to a player's action.

Merchandise games combine games of skill or chance with features of check operated vending machines. Although the prior art of check operated article dispensing machines provides many different delivery mechanisms, these are generally directed toward providing reliable operation and assuring that each actuation of the machine results in delivery of a selected product. Merchandise games, on the other hand, are intentionally less deterministic in their operation and require both a payment and a successful completion of a game of skill or chance to determine just what is to be delivered. Some such machines are configured to deliver one selected article on each actuation, as well as another "prize" article subject to a successful play. Others deliver one article per play, but allow the outcome of the game to determine the value or identity of the article delivered. Yet others deliver nothing unless the play is successful.

Exemplar merchandise games described in the patent literature are:

U.S. Pat. No. 6,315,157, wherein Halliburton teaches a merchandise game comprising a mechanism for moving a prize-engaging object vertically and horizontally across the face of the game in a successful play of Halliburton's game a ram moves into a prize-containing chamber responsive to a player's action and knocks a prize out of the back of the chamber into a delivery chute.

U.S. Pat. No. 6,209,868, wherein Norton discloses a dump truck game in which a toy truck oscillates laterally in front of the player at a fixed speed until a player supplies an input at a player-selected instant in order to begin a dump operation that drops a prize-containing ball onto a playing surface.

U.S. Pat. No. 5,848,935, wherein the inventor teaches a merchandise game in which a continuously moving component is halted responsive to a player's input and one of a plurality of visible items of merchandise is dispensed.

U.S. Pat. No. 5,558,340, wherein Ibe et al. teach a merchandise game having a grabbing mechanism that moves away from a player on a telescoping arm to grab a prize and pull it forward to a delivery chute near the face of the game.

SUMMARY OF THE INVENTION

One of the features of the invention is that it provides an arcade merchandise dispenser that delivers a visibly displayed article from one of a plurality of pivotally mounted trays if a user causes an oscillating tripper to strike a portion of the tray so as to lift it. In a preferred embodiment, the strikable portion of the tray is a finger or tab that protrudes forward from the tray towards the user.

Another aspect of the invention is that it provides a game of skill and chance in which a tripper, oscillating along a first axis at a constant rate, moves along a second axis, perpendicular to the first axis, responsive to a path-determining input from a player.

Yet another aspect of the invention is that it provides a method of operating an arcade merchandise game comprising a plurality of pivotally mounted trays. Each of the trays has a generally horizontal resting position in which a respective selected number of articles of merchandise may be placed on each of the trays, generally in a manner assuring that they are visible to a user of the game. A tripper, moving responsive to a user's action, may strike one or more of the trays and pivot it into a tilted delivery position in order to deliver all, some, or none of the articles of merchandise from the struck tray to a delivery chute. The fraction of articles delivered from a struck tray may depend on a variety of factors including, but not limited to: the size, weight, and mass distribution of each of the articles; the extent of frictional or interlocking contact between various of the articles; the slipperiness of packaging materials encasing any of the articles; and the details of how the tripper contacts the tray.

Yet another aspect of the invention is that it provides an arcade merchandise dispensing apparatus comprising a tripper movable along two mutually perpendicular axes. In some embodiments of the invention the tripper is capable of pivoting an article-retaining tray into a delivery position only when moving in a first of two directions along a selected one of the axes, and is not capable of pivoting an article delivery tray into a delivery position when moving in the opposite direction along the selected axis.

A preferred embodiment of the invention provides a merchandise game having a generally vertically disposed transparent front panel behind which a plurality of hinged trays are mounted. Each of the preferred trays has a trip tab extending forward from the tray toward the front panel. A tripper initially oscillates at a fixed speed along a generally horizontal axis selected so that the tripper does not engage any of the trip tabs. Responsive to a player's input, the tripper moves along a second, generally vertical, axis perpendicular to the first axis. If the tripper then strikes one of the trip tabs, the associated tray may be pivoted enough that one or more articles of merchandise disposed on the tray fall into a delivery chute.

A feature of some embodiments of the invention is a hingedly mounted tripper that can lift the front end of a struck tray when the tripper is moving upwards, and that can swing up and ride over any trip tab that the tripper strikes while moving downward to a starting position. A feature of some embodiments of the invention is the provision of at least one clear path along the second axis and a control system for moving the tripper downward along one of those paths either after a tripping event has occurred or after the trip finger has reached a position of maximum upward travel along the second axis.

Preferred embodiments of the invention comprise a trip sensor for detecting when a tripper has operatively contacted a trip tray and thereby delivered at least one article of merchandise. In some embodiments lacking a trip sensor, the tripper is arranged to move from a horizontal oscillation position to an uppermost travel position responsive to each player input. It will be understood that embodiments comprising the trip sensor may selectively operate in either manner.

In some modes of operation, the invention provides for stopping the oscillatory horizontal motion responsive to a user's input so that the vertical motion is directed substantially straight up from a user-selected position. In other modes of operation, the horizontal oscillation continues during the course of a user selected upward excursion of the tripper. Moreover, some modes of operation allow more than one user input per play, so that the user can stop and restart the vertical motion some number of times while the horizontal oscillation is in process.

Although it is believed that the foregoing recital of features and advantages may be of use to one who is skilled in the art and who wishes to learn how to practice the invention, it will be recognized that the foregoing recital is not intended to list all of the features and advantages. Moreover, it may be noted that various embodiments of the invention may provide various combinations of the hereinbefore recited features and advantages of the invention, and that less than all of the recited features and advantages may be provided by some embodiments.

DETAILED DESCRIPTION OF A PREFERRED EMBODIMENT

Figure 1:
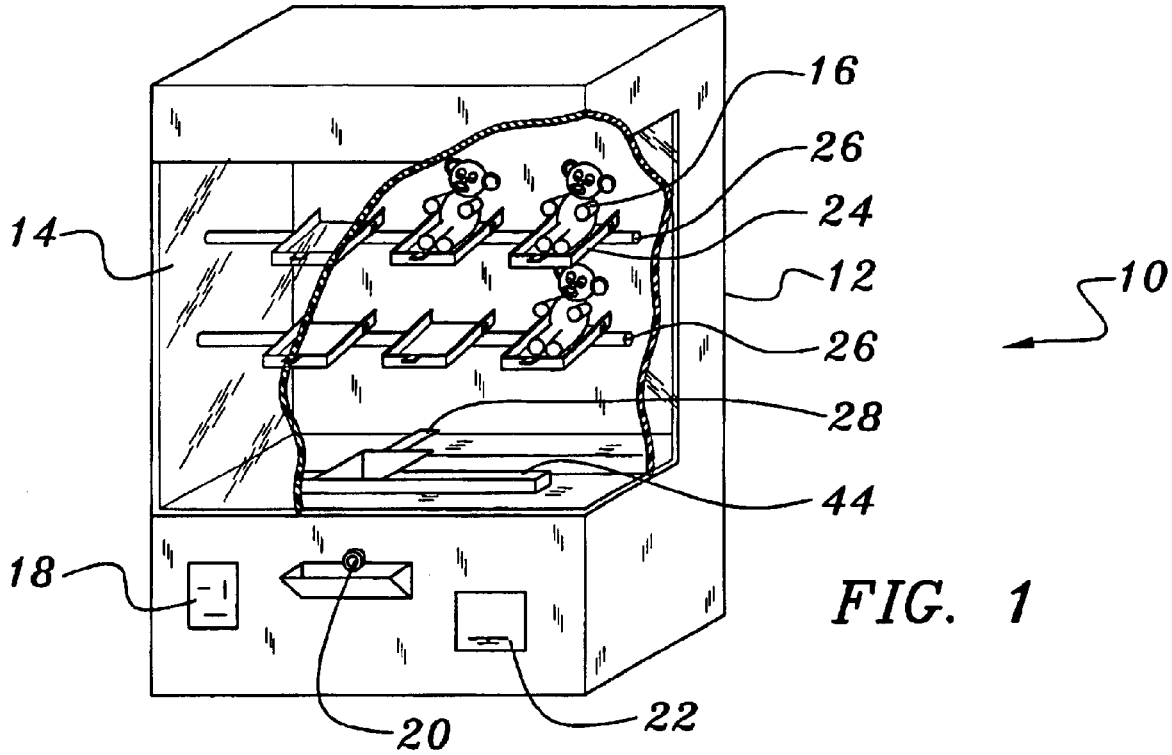
FIG. 1 is a partly cut-away elevational view of an arcade game of the invention.

Merchandise game apparatus 10 of the invention is preferably configured to fit within an upstanding cabinet 12 having a transparent front face 14 behind which various items of merchandise 16, commonly referred to as "prizes" are displayed to potential users of the machine. In order to play the game, the user, or player, makes a payment, which may be by deposit of a check, coin or bill into a check acceptor 18, although other forms of payment, such as by means of a credit or debit card which may be tendered at the machine or to a remotely located employee of the game's operator, are also known. A console 20 is generally disposed on the front of the cabinet 12 for the player's use to supply an input or inputs that determine or influence which item of merchandise, if any, is delivered. As is common in the art, the merchandise may be delivered by being dropped into a delivery chute 22 for retrieval by the player.

In a preferred embodiment of the invention the prizes 16 are displayed in a plurality of pivotable trays 24, each of which is hingedly connected to one of a plurality of horizontal rods or tubes 26 fixedly connected to the cabinet and that are arrayed parallel to the front face 14 of the game so that each rod extends at least part way across the front face 14, thus forming a plurality of horizontal rows of prize-containing trays 24. It is, of course, possible to dispense with the rods and to directly hingedly connect each of the trays to some other fixed point, such as a back panel of the cabinet. It will be appreciated that although the preferred apparatus employs horizontal rows of trays arrayed in front of a vertical back panel of a cabinet in order to minimize the distance that the front of the game extends away from a building wall into an arcade, one could choose to make a game with a tilted front panel 14 and an array of trays supported by horizontal rods disposed in a tilted plane generally parallel to the tilted front face of the game.

Many configurations for the tray array may be selected. In some versions of the game a relatively small number of trays, each containing a prize of relatively high value 16*a* may be attached to the uppermost of the rods 26 and a larger number of trays containing lower value prizes 16*b* are arrayed on lower ones of the tubes. An arrangement of this sort increases the probability that a discharge assistant, hereinafter referred to as a "tripper" 28, moving upwardly through the array of trays, will hit one of the lower valued trays before it can reach a tray containing a higher valued prize. In other variations the trays may be spaced apart on the rods to provide at least one generally vertical channel or aisle through which a tripper 28 can move without contacting any of the trays so that the tripper can be returned to its initial position beneath the lowest row of trays at the end of each play. Those skilled in the control arts will recognize that a variety of return paths can be selected for this reset operation so that a clearly visible vertical aisle can be avoided if desired.

In a preferred embodiment each of the trays 24 comprises a trip tab 30 on its front end 32 distal from a hinge 34 connecting it to one of the rods 26. A preferred tab 30 extends forwardly from its tray 24 far enough that a tripper 28, moving about in a plane parallel to the front face of the game, is able to strike the tab, but is not able to strike the body of the tray. As will become clear from the following discussion of the game's operation, the probability that any given tab is struck by the tripper varies with the width of the tab. A wide tab increases the odds of being hit by the tripper and thus increases the probability of delivery occurring from the associated tray. It will be recognized that if this measure of control is not desired, one can omit the trip tabs and extend the tripper so that it can coact directly with the tab-free trays.

Figure 2:
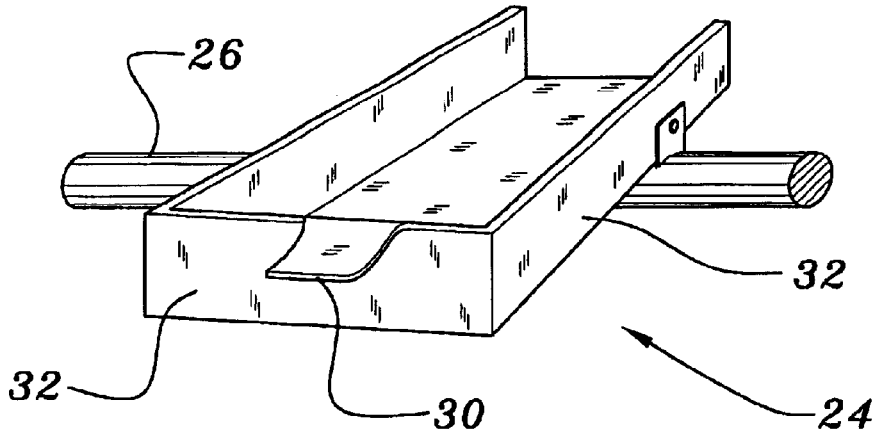
FIG. 2 is an elevational view of a pivotally-mounted merchandise tray.

The tray 24 is depicted in FIG. 2 as having an upstanding front wall 32 and two upstanding side walls. There is no wall at the rear end of the depicted tray proximate the hinge 34. This preferred arrangement allows the tray to retain prizes of various sizes without inhibiting their delivery when the front of the tray is tilted upwardly. It will be recognized that other sorts of tray designs could be employed. A tray having no upstanding walls, for example, might be more compatible with the display of relatively large prizes. A tray having a rear wall, on the other hand, could be used to inhibit a player from maliciously rocking the cabinet in the hope of dislodging a prize from one of the trays.

Figure 3:
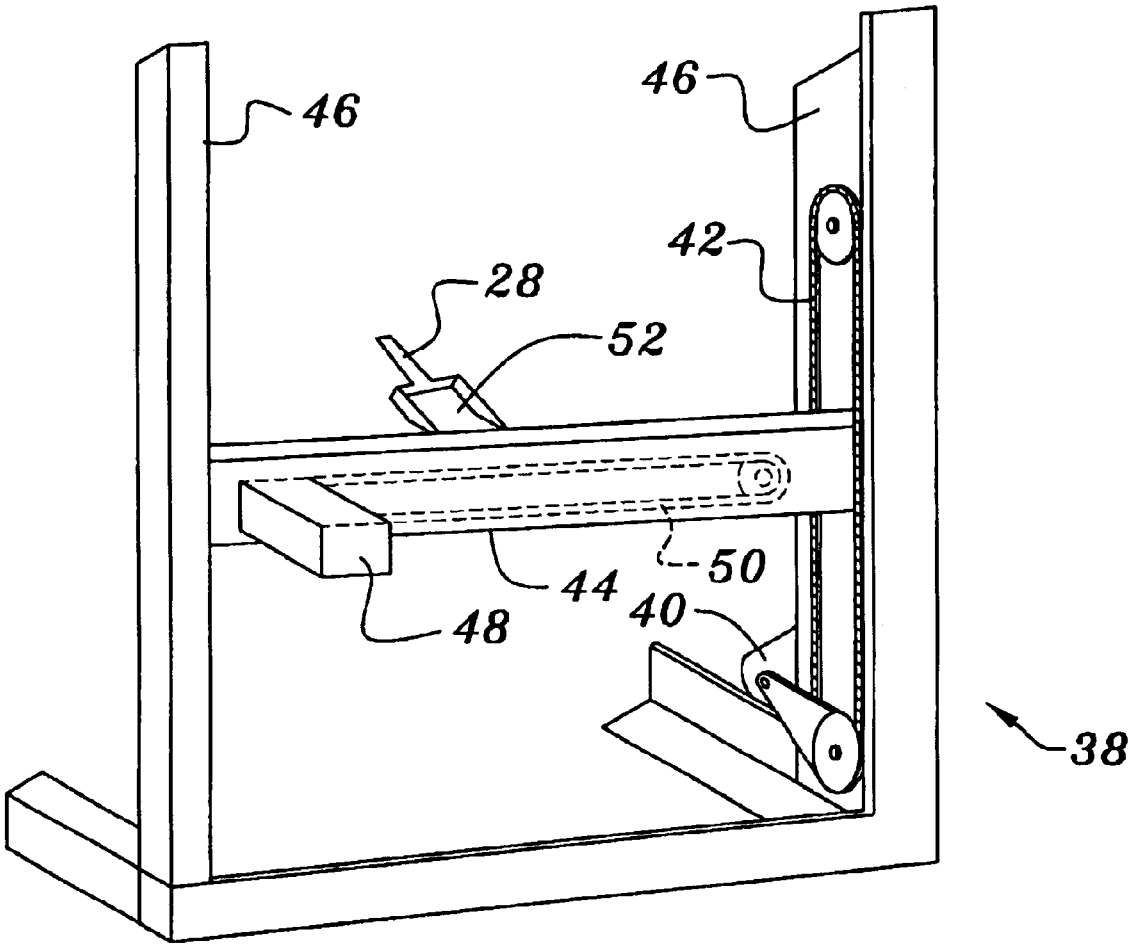
FIG. 3 is an internal elevational view of a tripper traversing mechanism used in the arcade game of FIG. 1.

A tripper 28 component is generally configured to be movable in two dimensions along a plane surface, which is usually vertical, and which is defined by the leading edges of the trip tabs 30. An exemplar tripper traversing mechanism 38, depicted in FIG. 3 of the drawing, employs a motor 40 and a cross-ribbed belt 42 to drive a horizontal carrier 44 along a pair of tracks 46 lying in the plane defined by the trip tabs. A second motor 48 and second cross-ribbed belt 50 are used to drive a tripper support 52 back and forth along the horizontal carrier 44. Those skilled in the arts will recognize that many other mechanisms could be used to produce controllable motion along either or both of the horizontal and vertical axes. Such other mechanisms include, but are not limited to, the use of a spiral-grooved guide rod 54 of the sort commonly used in level wind mechanisms found on bait casting reels.

Figure 4:
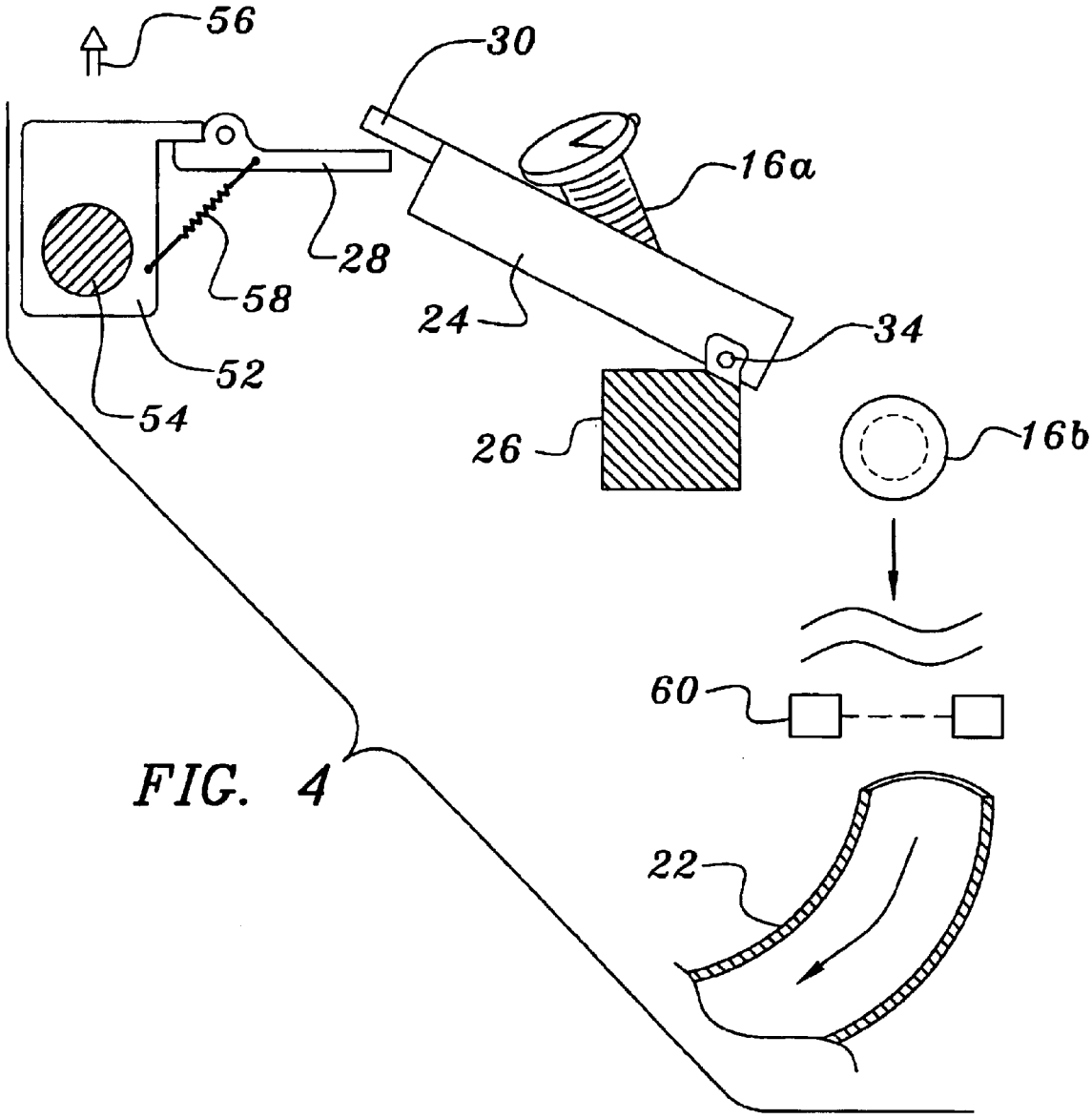
FIG. 4 is a partly schematic, partly sectional view of a tray-tipping operation.
Figure 5:
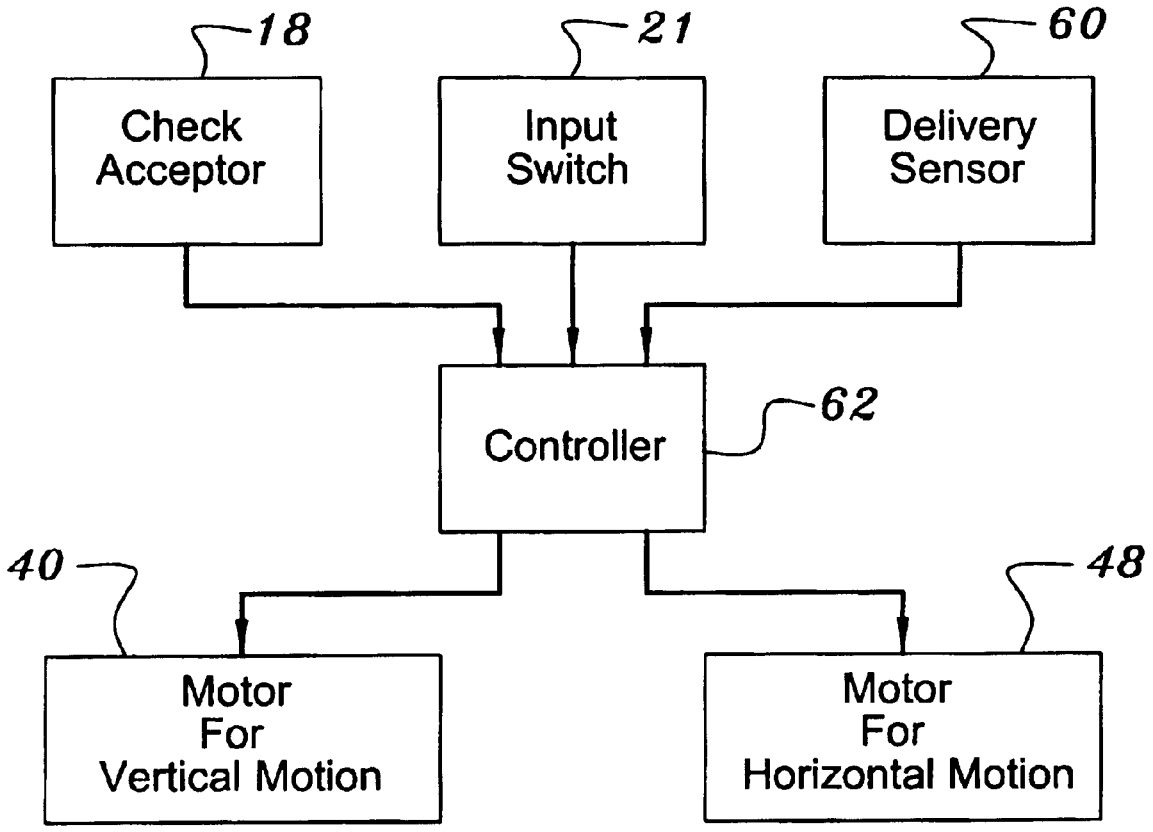
FIG. 5 is a schematic block diagram of a control system for controlling an arcade game of the invention.

The tripper 28 is used to dispense one or more prizes by tipping the front end of a tray upwardly when the tripper 28 is moved upwardly, as indicated by the double-tailed arrow 56 in FIG. 4. In a preferred method of using the apparatus of the invention, after delivering a prize by tipping a tray, the tripper 28 returns to a selected starting position, which is generally at a level below the lowest row of prizes. There are several approaches to ensuring that the tripper does not become jammed by hitting a tray during this reset operation.

In some embodiments of the invention the tripper is hingedly attached to the tripper support 52 and biased into an operative position by means of a spring 58. This allows the tripper finger 28 to tilt upwardly and ride over any trip tab that it contacts while moving downward during the reset operation. It will be recognized that entirely equivalent structures can be made by using a tripper heavy enough to reliably return to a operative position without requiring a bias spring 58, or by using a tripper fabricated from a material that is sufficiently flexible to ride over the trip tabs during reset, but yet stiff enough to lift a tray containing the heaviest prize to be dispensed. It is, of course, also possible to avoid contact with all trip tabs during reset by providing a tab-free vertical channel or aisle along which the tripper can be moved during reset.

In a preferred embodiment, the apparatus 10 comprises one ore more delivery sensors 60 for determining when one of the trays has been lifted far enough to deliver a product. In a preferred embodiment a single sensor 60, which may comprise a photoemitter-photodetector pair but which may be any of a variety of known sensors, is installed in or near the discharge chute 22. Although it is generally more economical to use a single such sensor that can provide an output to a controller 62 responsive to an item falling from any of the trays into the discharge chute, one can also use other sensing devices, such a microswitches, and associate a separate sensing device with each tray or which each row of trays.

An arcade game 10 of the invention may be operated in many fashions, many of which ask a player to guess the ideal moment to provide an input that initiates vertical motion of the tripper. In a preferred method of operation, the controller 62 controls the tripper 28 to oscillate back and forth along the carrier 44 at a lowest point of travel for the carrier whenever the game is being used by a player, and, in some cases, whenever the game is available for use, inasmuch as the moving tripper may attract players to the machine. After a player has initiated an operational cycle of the game 10 by providing a selected payment amount, the player is able to initiate motion of the tripper in the direction perpendicular to the carrier. In some versions of the game the player's console 20 has a single momentary contact switch 21 disposed on it. Hitting that switch, in this method of play, may causes the controller to immediately initiate vertical motion of the tripper while horizontal oscillation continues, or to initiate such motion subsequent to a delay. Thus, the tripper executes an upward excursion that may be along a slanted or zig-zag path that the player tries to predict. If the upwardly moving tripper strikes a trip tab and lifts the associated tray enough to dispense a prize, the output from the sensor 60 causes the controller 62 to halt upward motion and to return the carrier to its lowest point of travel in preparation for another play. Those skilled in the art will appreciate that the drop distance between a tilted tray and a sensor 60 and the upward speed of the tripper may be selected so that the tripper does not move upwards far enough after tripping one tray to trip a tray in the row above. Alternately, these parameters can be selected so as to provide a possibility of multiple 'tray hits' on a single actuation.

As noted above, the probability that the tripper strikes a trip tab is higher if the trip tab is relatively wide. Because the tripper is moving both horizontally and vertically during the preferred method of play, the width of the trip tab affects not only its chance of being struck, but also the extent to which the tray is pivoted upward. The time that the tripper spends in contact with a tab depends on both the width of the tab and the location along the width of the tab at which initial contact occurs. That is, the front edge of the associated tray will be lifted by an amount equal to the product of the vertical tripper speed and the fractional width of the tab that is contacted by the tripper, divided by the horizontal oscillation speed. If the tripper hits a tab at a leading edge and rubs across the entire tab width while moving upward, maximum lifting occurs. Correspondingly, if the tripper hits an edge of a tab as it is moving horizontally away from that tab, little lifting will occur.

The game of the invention thus permits a wide variation in both the nature and extent of merchandise delivery at each play. Clearly, the nature of what is delivered depends on which tray is struck. Because of the variable extent of lifting noted above, it should also be clear that if more than one item is initially loaded into a tray struck by the tripper, and some of the items are easier to dislodge than others, the impact may deliver all, some, or none of the items. The ease of dislodging an item from a tray can vary with the size, weight, and shape of the object, as well as with the relative slipperiness of the object or of its packaging. For example, the depiction of FIG. 4 shows a relatively high value item 16*a* (e.g., a watch) remaining in a tripped tray after a smaller prize 16*b* in a spherical package has been dispensed.

It will be recognized that other methods of operation may also be employed. For example, the controller 62 may halt the oscillatory motion of the tripper responsive to a player's input and then initiate vertical motion of the tripper. In this case, a trip tab would have to be directly above the horizontal stopping position of the tripper in order for a delivery to occur. Additionally, one could configure a game of the invention to make a complete vertical excursion, which might result in multiple tripping events, each time a player initiates play. Moreover, if the operator of the apparatus 10 chooses, or is constrained by regulations to deliver at least one item of merchandise on each play, the apparatus can operate under program control to return the tripper to its lowest point of travel and permit the player to initiate a repeated upward pass of the tripper if an earlier pass failed to tip any of the trays far enough to deliver at least one article of merchandise.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. A merchandise game apparatus for delivering at least one of a plurality of items of merchandise to a player, the apparatus comprising:

a plurality of trays, each tray for holding at least one of the items of merchandise, each of the trays having a respective front end proximal a front face of the game apparatus and lying in a common plane, each of the trays having a respective rear end distal from the front face of the game apparatus, each of the trays hingedly connected adjacent its respective rear end to a fixed support so that it can be pivoted from a substantially horizontal resting position into a respective tilted delivery position by lifting the respective front end far enough so that the at least one item slides off the rear end of the tray into a delivery chute under the influence of gravity;

a tripper disposed adjacent the front face and extending away from the front face far enough that a portion of the tripper lies in the common plane defined by the fronts of the trays;

a tripper traversing mechanism for oscillating the tripper along a first axis parallel to the common plane at a selected rate unaffected by any action of the player, the traversing mechanism also for moving the tripper, responsive to an input from the player, along a second axis, perpendicular to the first axis and parallel to the common plane; and a player operated mechanism for supplying the input;

whereby the apparatus delivers the at least one item of merchandise only if the tripper strikes a front portion of one of the trays and pivots that tray about its respective hinge into its respective product delivery position.

2. The apparatus of claim 1 wherein the trays are arranged in a plurality of horizontal rows and wherein the first axis is disposed beneath a lowest of the plurality of rows.

3. The apparatus of claim 1 wherein the trays are arranged in a first selected number of horizontal rows, each of the rows comprising a respective number, less than the total number of trays in the plurality thereof, of trays respectively directly hingedly connected to a rod extending at least part way across the face of the game, each of the rods fixedly attached to a cabinet of the game.

4. The apparatus of claim 1 wherein the player operated mechanism comprises a momentary contact electrical switch.

5. A method of dispensing to a player at least one of a plurality of items of merchandise displayed behind a transparent front panel of a merchandise game comprising a plurality of trays, each of the trays holding at least one of the items of merchandise, the method comprising the sequentially executed steps undertaken by the player of:

paying a predetermined sum to gain access to the game; and supplying an input at a selected instant to initiate upward motion of a tripper oscillating at an initial level beneath a lowest one of the trays, the tripper extending far enough behind the front panel to strike a portion of a tray as the tripper moves upward;

and the sequentially executed steps undertaken by a contoller controlling the game of:

accepting the payment by the player and waiting for the input from the player;

moving the tripper upwardly subsequent to receiving the input from the player until a second input from a delivery sensor indicates that the tripper has struck one of the trays so as to tilt a forward edge of the struck tray upwards and to discharge the at least one item of merchandise therefrom; and returning the tripper to its initial level.

6. The method of claim 5 wherein the step of returning the tripper to its initial level comprises moving the tripper downward along a path selected so that the downwardly moving tripper does not contact any of the trays.

7. The method of claim 5 wherein the tripper comprises means allowing it to tilt upward and ride over any of the trays that it contacts while being returned to its initial level.

8. The method of claim 5 wherein the delivery sensor comprises means for sensing that the at least one of the prizes has fallen into a delivery chute for delivery to the player.

9. The method of claim 5 wherein the player supplies the input by actuating a momentary contact switch.

10. An apparatus for a merchandise game in which at least one article of merchandise is dispensed only if a player selects an appropriate instant at which to provide an input, the apparatus comprising:

a cabinet comprising a transparent front face, the cabinet having a plurality of horizontal support members fixedly attached thereto in parallel alignment so that each of the horizontal support members extends at least partially across the front face, each of the support members having a respective selected number of trays connected thereto in respective spaced apart arrangements;

each of the trays having a front end proximal the front face of the cabinet and a rear end distal therefrom, each of the trays respectively hingedly connected adjacent its rear end to the associated one of the horizontal support members, each of the trays respectively pivotally movable about its respective hinge from a resting position into a tilted delivery position;

a traversing mechanism adjacent the front face, the traversing mechanism for moving a tripper along a path parallel to the front face, the tripper extending rearwardly far enough from the front face to contact any of the trays disposed along the path and to move the contacted tray from its resting position toward its delivery position; and a momentary contact switch operable by the player to provide the input to a controller for controlling the motion of the traversing mechanism along the path.

11. The apparatus of claim 10 wherein each of the trays comprises a respective trip tab at its front end, each of the trip tabs having a respective selected width.

12. The apparatus of claim 10, further comprising a delivery sensor responsive to the at least one product falling from the tray in the delivery position, the delivery sensor having an output to the controller for stopping the motion of the traversing mechanism along the path.

* * * * *